United States Patent [19]

Ellis et al.

[11] Patent Number: 4,889,263

[45] Date of Patent: Dec. 26, 1989

[54] SEALED BIN CONTAINER

[76] Inventors: John P. Ellis, 9211 South Keeler; Chris P. Ellis, 9124 South Tripp, both of Oak Lawn, Ill. 60453

[21] Appl. No.: 270,058

[22] Filed: Nov. 14, 1988

Related U.S. Application Data

[63] Continuation-in-part of Ser. No. 69,634, Jul. 6, 1987, abandoned.

[51] Int. Cl.[4] ..... B67D 5/06

[52] U.S. Cl. ..... 222/185; 222/357; 222/404; 222/503; 277/212 FB

[58] Field of Search ..... 222/356, 357, 404, 409, 222/361, 502, 503, 185, 181, 424.5, 209, 490, 570; 294/131; 414/1, 8; 403/50, 51; 277/212 FB

[56] References Cited

U.S. PATENT DOCUMENTS

| | | | |
|---|---|---|---|
| 1,218,092 | 3/1917 | Larsen | 222/356 |
| 2,209,115 | 7/1940 | Fitzgerald | 222/503 |
| 2,830,744 | 4/1958 | Polsen et al. | 222/567 X |
| 3,146,924 | 9/1964 | Cozadd et al. | 222/503 |
| 3,279,656 | 10/1966 | Axtell et al. | 222/503 X |
| 3,704,894 | 12/1972 | Didszuhn | 277/212 FB |
| 4,006,850 | 2/1977 | Farina | 222/356 |
| 4,211,343 | 7/1980 | Hughes et al. | 222/356 X |
| 4,311,257 | 1/1982 | Grieco et al. | 222/494 X |
| 4,527,803 | 7/1985 | Rose | 277/212 FB |
| 4,562,941 | 1/1986 | Sanfilippo | 222/361 X |
| 4,589,576 | 5/1986 | Knight et al. | 222/566 X |
| 4,592,494 | 6/1986 | Ellis et al. | 222/357 X |
| 4,650,098 | 3/1987 | Ellis et al. | 222/357 X |
| 4,676,513 | 6/1987 | Tiegs et al. | 277/212 FB |
| 4,718,578 | 1/1988 | Radek et al. | 222/357 X |

FOREIGN PATENT DOCUMENTS

| | | | |
|---|---|---|---|
| 1206451 | 6/1986 | Canada | 222/457 |
| 1525900 | 9/1969 | Fed. Rep. of Germany FB | 277/212 |
| 1906310 | 9/1970 | Fed. Rep. of Germany | 414/8 |

*Primary Examiner*—Joseph J. Rolla
*Assistant Examiner*—Gregory L. Huson
*Attorney, Agent, or Firm*—Basil E. Demeur; Robert E. Knechtel; Alan B. Samlan

[57] ABSTRACT

There is disclosed a sealed barrier container adapted to contain a supply of bulk food product for metered dispensing therefrom, of the type having a chamber to contain food product in a hopper, and a dispensing portion being in operative relation with the hopper. The front portion of the container is provided with a flexible boot mounted in the container which encloses the opening to the container therein. The boot has an inner end for mounting to the container in an overlying relationship with respect to the opening and a scoop carried by the boot. The scoop includes an elongate handle having an outer end extending through the outer end of the boot, and the inner end is adapted to retrieve product from the product ramp contained within the container. The boot permits the scoop to operate in a reciprocal as well as orbital and lateral fashion in order to simplify the process of food retrieval. The device further includes a movable closure carried in the exit chute portion to prevent access to the internal confines of the container during the food retrieval process.

4 Claims, 2 Drawing Sheets

10
12
13
14
15
18
19
21
22
25
26
27
28
30
31
32
33
35
37
38
40
3
2

25
27
28
42
43
45
47
48
50
52
55
56

25
26
27
32
33
42
43
45
46
47
48
50
52
53
55
56

FIG. 4
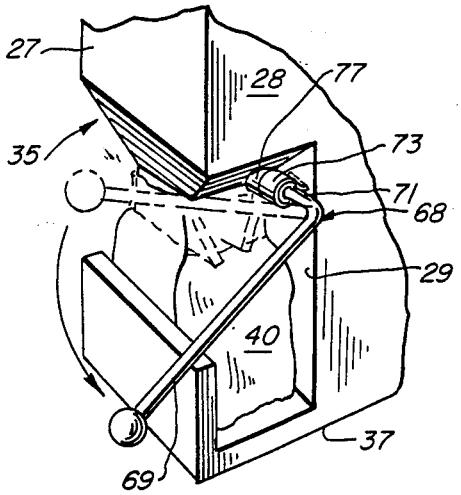
FIG. 7
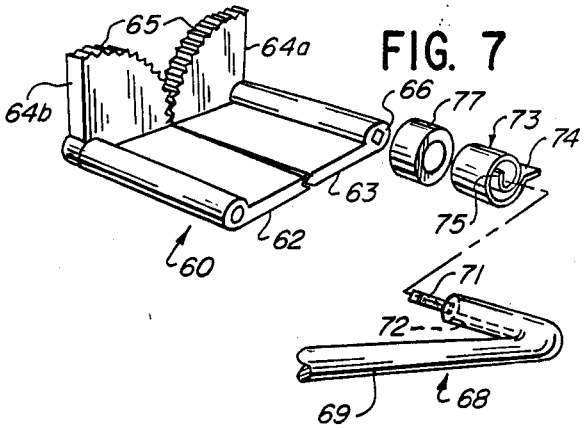
FIG. 5
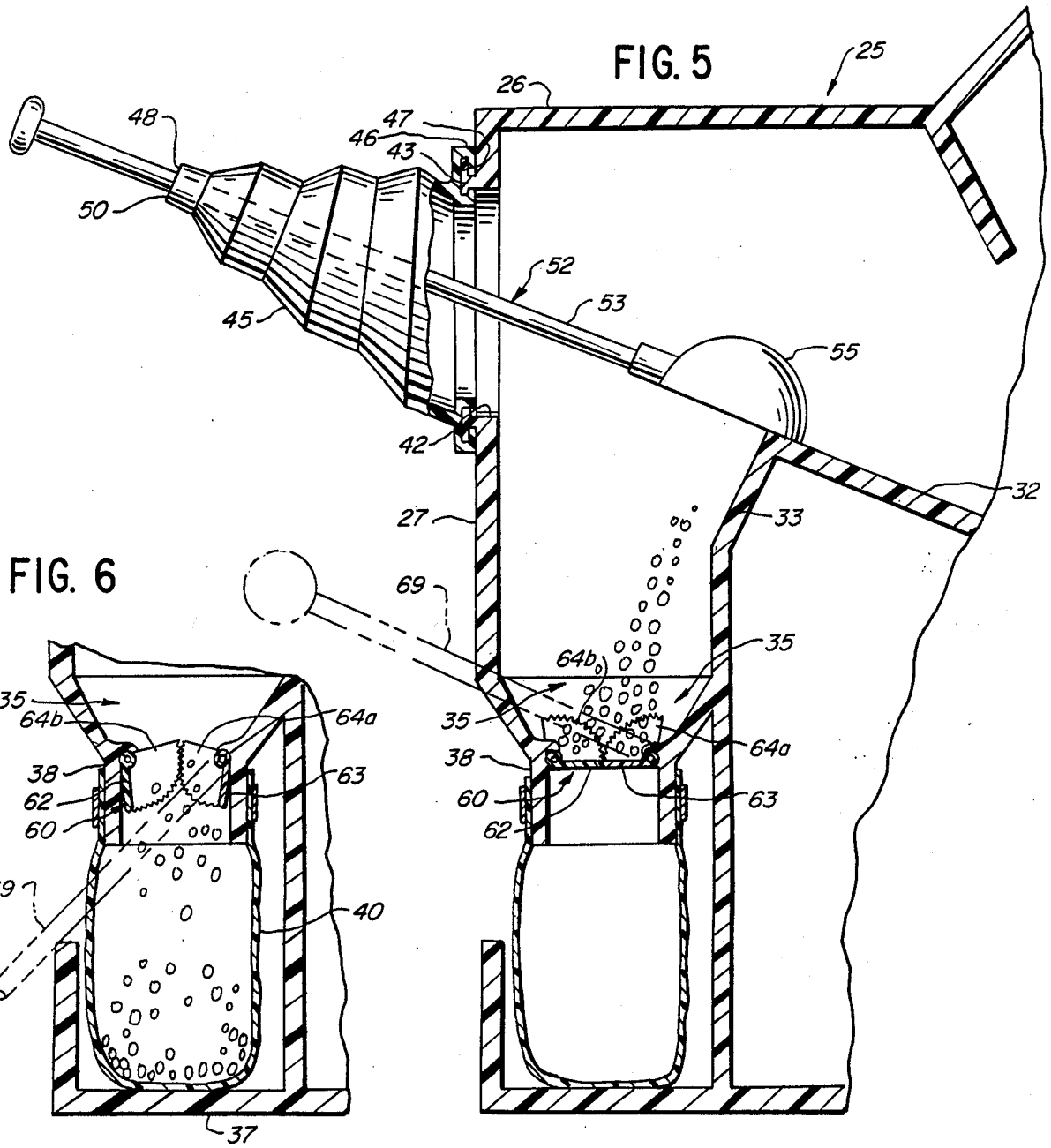
FIG. 6

SEALED BIN CONTAINER

CROSS-REFERENCE TO RELATED APPLICATION

This application is a continuation-in-part application of application serial no. 069,634 filed on July 6, 1987 in the names of John P. Ellis and Chris P. Ellis and entitled "Improved Sealed Barrier Container" and not abandoned.

BACKGROUND OF THE INVENTION

With respect to the application which was previously filed, it is presently well known that various products, especially food product, are now being sold to the consuming public directly from bulk containers. For many years, food products such as vegetables and the like have been sold from coolers, permitting the consumer to physically remove the desired quantity of product from the coolers into bags or other containers, primarily as a convenience to the consumer. It has now become in vogue to sell numerous other food products from bulk containers thereby permitting the consumer to remove any desired quantity of product from the bulk container, and to bag the same himself. In addition to other conveniences, it is a cost saving feature to a store since the labor costs are thereby substantially reduced.

However, it is now known that tampering and/or contamination is quite possible where the product is openly available to the public, and there has now developed a need to contain such product within containers which do not permit access. Hence, if food product is to be sold in bulk form to the public, it is imperative that containers be developed which are basically sealed containers, and provide virtually no access to the consuming public during the food retrieval process.

The inventors herein have developed a series of sealed barrier containers, of the type shown for example in patent no. 4,569,377, which is a very basic sealed bin container. The inventors herein have further developed alternate versions of sealed bin containers such as those shown in patent no. 4,592,494, as well as the type described in the inventors subsequent patent no. 4,650,098. Each of these containers have, in common, the feature of having product contained within the container which is totally enclosed, and permits virtually no access to the public. The containers are the type having a hopper upper portion thereof, wherein food product may be inserted by the store owner, and the access door then locked. The hopper leads to a food or product ramp, contained within the dispensing portion of the container. The food retrieval means in the nature of a scoop or other device is then provided in the dispensing portion, the scoop or other food retrieval means being controllable from the outside of the container and permitting the operator to retrieve food from the product ramp, and to deposit the same in an exit chute adjacent the lower portion of the container. The consumer may position a bag or other container at the exit end of the exit chute, such that when food product is retrieved from the product ramp, by means of the scoop or other food retrieval means, the food will exit through the exit chute and directly into the container.

Each of the containers shown in the above-mentioned patents, once again, have in common the feature of totally enclosing the container so that the food product contained therein is nonaccessible to the public thereby to prevent contamination and/or tampering. However, it is deemed to be important to the operation of the systems to provide food retrieval means which is simple in construction, and yet efficient in operation. As was shown in patent no. 4,592,494, different verions of scoop means are shown therein which are operable from the external portion of the container, in order to retrieve food or product from the product ramp and to deposit the same through the exit chute into the receptacle.

While the systems disclosed in the aforementioned patents are effective for the purpose intended, it was deemed desirable to further simplify the food retrieval means primarily from the standpoint of manufacturing costs, as well as to significantly increase the operability of the device. It was specifically found that especially with respect to the device depicted in applicant's patent no. 4,592,494, the movement of the scoop means was limited by the enclosure or opening in which the scoop means was contained. For example, the embodiment as shown in FIG. 9 of patent no. 4,592,494, while permitting arcuate motion as well as lateral motion of the scoop means relative to the container, such movement is limited due to the fact that the scoop means is contained within a slotted opening such that the degree of arcuate movement is limited by the confines of the slotted opening. Hence, pursuant to the present invention, further improvements have been developed which both simplified the food retrieval means of the scoop means, and furthermore, permits a wide degree of orbital movement such that the user will have a high degree of flexibility in terms of food retrieval when operating the scoop means. The device of the present invention permits the easy and efficient retrieval of product from the product ramp by not only simplifying the mechanical components of the device, but rendering the use of the device more flexible in that a higher degree of movement is permitted. The present invention further provides a closure system for the exit chute to ensure that unauthorized access into the container is not improperly gained through the exit chute portion of the device, while nevertheless, avoiding any interference with the operation of the food retrieval means for retrieving product from the container and into the exit chute.

OBJECTS AND ADVANTAGES

It is therefore the principal object of the present invention to provide a sealed barrier container of the type which has an upper portion for containing a food hopper carrying food in bulk form, an intermediate dispensing portion which contains a food retrieval system, and a base portion for supporting the container, wherein the food retrieval system has been simplified to basically a two component system.

In conjunction with the foregoing object, it is a further object of the present invention to provide a sealed barrier container of the type described wherein the food retrieval system consists mainly of a flexible boot mounted to the container externally thereof, and overlying an opening in the front portion of the dispensing portion of the container an in sealing engagement therewith, and scooping means carried by the boot, the scoop means including an elongate handle having an outer end extending through the outer end of the boot, and an inner end adapted to retrieve product from the product ramp, the outer end of the boot being in sealing engagement with a portion of the outer end of the handle of the scoop means, and the handle terminating at the outer end thereof in a grasp portion such that the operator may grasp the grasp portion of the handle to manipulate the inner end thereof in order to retrieve produce from the product ramp, the provision of a flexible boot permitting the handle to be manipulated in a reciprocating motion as well as permitting lateral movement and orbital movement bounded only by the internal confines of the container, such that the food retriever may be easily and efficiently manipulated to retrieve product from the product ramp.

In conjunction with the foregoing objects, it is a further object of the present invention to provide a sealed barrier container of the type described having an improved food retrieval system wherein the boot is formed from a flexible resilient material, such that the scoop means carried thereby is movable in all directions.

In conjunction with the foregoing object, it is a further object of the present invention to provide a food retrieval system associated with a sealed barrier container of the type described wherein the boot assumes an accordion style configuration in order to enhance the flexibility thereof.

Still a further object of the present invention is to provide a sealed barrier container of the type described which further includes movable closure means carried in the exit chute alternately movable between a closed position to trap produce therein and an open position in order to release product therefrom into the exit chute and into a waiting receptacle.

In conjunction with the foregoing object, it is a further object of the present invention to provide a closure means carried in the exit chute of the sealed barrier container of the type described wherein the closure means is formed by a pair of closure doors each having an outer side edge adapted for pivotal mounting within the exit chute, and mating inner side edges, the mating inner side edges adapted to alternately open and close, and control means for controlling the alternate opening and closing of the closure doors.

In conjunction with the foregoing objects, it is a further object of the present invention to provide a sealed barrier container of the type described wherein the closure doors each includes a toothed gear plate, each of the two gear plates being in mating engagement with each other thereby to control the alternate opening and closing of the closure doors, and a controller mounted to at least one of the closure doors for controlling the alternate opening and closing of one of the closure doors, the other of the pair of closure doors being driven by the action of the mating toothed gear plate.

Further features of the invention pertain to the particular arrangement of the elements and parts whereby the above-outlined and additional operating features thereof are attained.

The invention, both as to its organization and method of operation, together with further objects and advantages thereof, will best be understood by reference to the following specification taken in conjunction with the accompanying drawings.

BRIEF DESCRIPTION OF DRAWINGS

FIG. 4 is a perspective view, broken away, showing the exit chute portion of the container, and illustrating the movement of the controller for the closure doors associated with the exit chute;

FIG. 5 is a side elevational view, partly broken away and in cross section, showing the closure doors as mounted in the exit chute portion of the container in the closed position thereby to entrap product retrieved from the product ramp and deposited into the exit chute;

FIG. 6 is a side elevational view, partly broken away and in cross-section, showing the operation of the controller to move the closure doors from the closed trap position to the opened position such that product deposited within the exit chute may now be deposited in the waiting receptacle; and FIG. 7 is a perspective view showing the details of construction of the closure doors including the gear plates, and the controller therefor, and illustrating the spring mechanism for returning the controller to its normally closed position.

BRIEF SUMMARY OF THE INVENTION

In summary, the present invention is intended to provide a simplified food retrieval system for a sealed barrier container which permits the operator to manipulate the food retriever from a position external of the container, but efficiently and easily remove product from the product ramp within the container. The food retrieval system of the present invention has been reduced to a two component system which is basically formed by a flexible boot which is mounted to the container exteriorly thereof and in overlying relationship with respect to the opening in the front wall, and a scoop carried by the boot, having a handle portion at the outer end thereof, and terminating in a scoop or food retrieving portion at the inner end thereof within the container. The provision of a flexible boot permits reciprocating movement, lateral movement, as well as orbital movement of the scoop within the confines of the container such that the food retrieval process is rendered more efficient.

In addition, the present invention provides a closure system for the exit chute which, once again, is controlled externally of the container, so that access to the interior confines of the container is prevented under all circumstances except when product is being removed from the exit chute and into a waiting receptacle. A controller is provided for the closure system which is adapted to be kept in a normally closed position such that the container is virtualy inaccessible and thereby prevents any possible tampering or contamination with product contained therein.

In summary, the present invention permits the food retrieval system as well as the product exiting system to be fully controlled from externally of the container while at all times, maintaining the sterility and integrity of the product contained within the container.

DETAILED DESCRIPTION OF DRAWINGS

Figure 1:
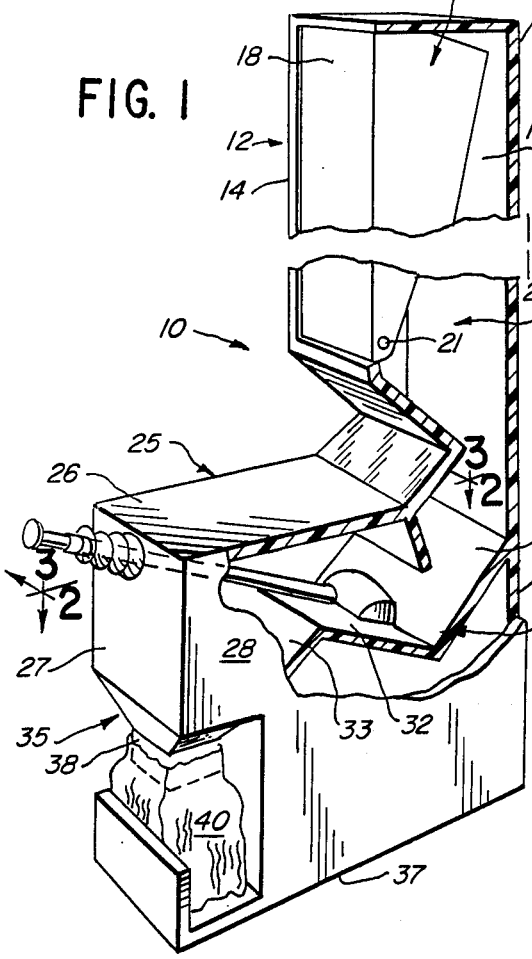
Figure 3:
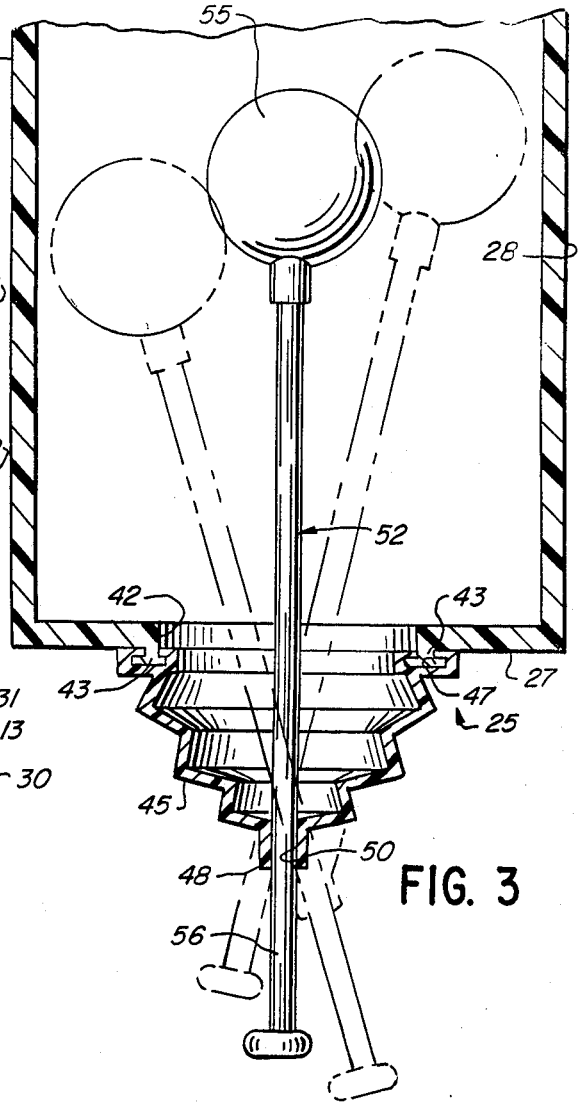
FIG. 3 is a top view, in cross-section showing the method of operation of the two element food retrieval system including the boot and the scoop, all taken in the direction of the arrows along the line 3—3 of FIG. 1.
Figure 2:
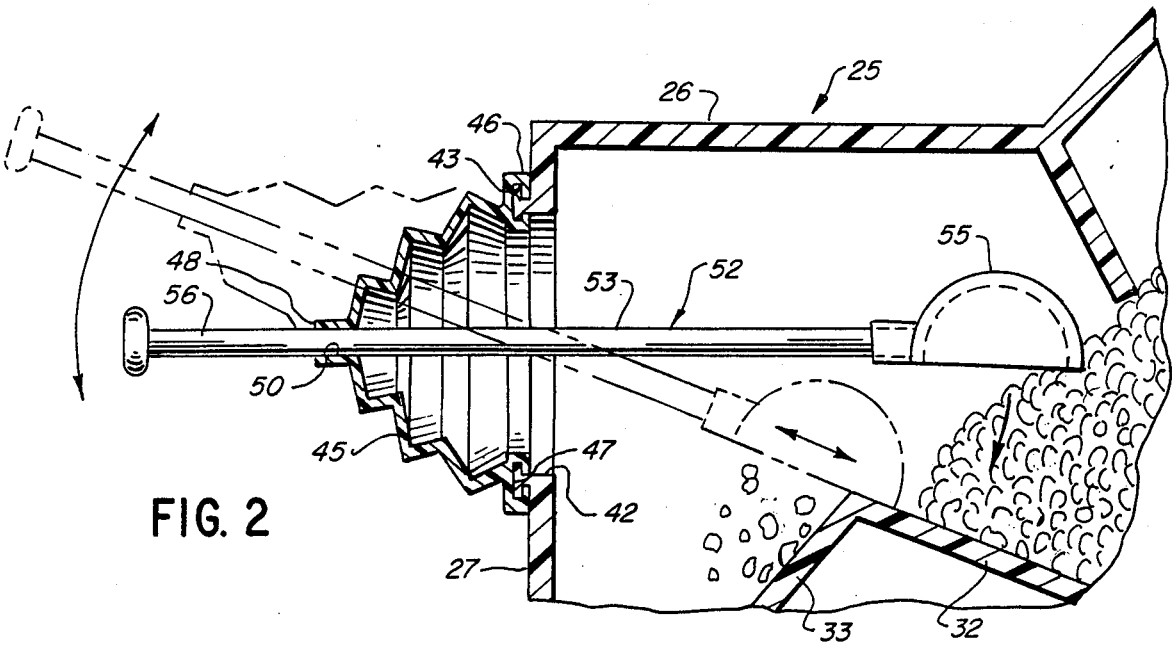
FIG. 2 is a side elevational view, partly broken away, and in cross-section, showing the details of construction of the two component food retrieval system including the boot, and the scoop means carried by the boot, all taken in the direction of the arrows along the line 2—2 of FIG. 1.

As shown in FIGS. 1 through 3 of the drawings, a sealed container 10 is provided of the type heretofore disclosed in applicant's patents 4,650,098 as well as patent no. 4,592,494. The sealed container is shown to be provided with an upper portion 12, which is formed by a back wall 13, a front wall 14, opposed side walls 15, and a top wall 16. The front wall 14 is actually formed by an access panel 18 which is in the form of a hopper 19 pivotally secured to opposed side walls 15 by means of pivot pins 21. The hopper 19 provides the access to the product chamber 22 thereby to permit product to be transported to the dispensing portion 25 of the container 10. In use, it is contemplated that the hopper 19 would be locked to the top wall 16 to prevent unauthorized access thereto.

The dispensing portion 25 is shown to include a top wall 26, a front wall 27, opposed side walls 28, and enclosed by the back wall 13. A product ramp 30 is provided in the interior confines of the dispensing portion 25 which is formed by a first declining ramp 31, a second inclining ramp 32 formed integrally with ramp 31. The ramps 31 and 32 together are basically V-shaped in configuration thereby to entrap product as the same is transported through the product chamber 22. The product ramp 30 is completed by a declining food transport ramp 33 which leads into the exit chute portion 35 (see FIG. 5). The sealed container 10 is shown to include a base portion 37 which supports the entire unit. The exit chute portion 35 is shown to include a collar 38 which is designed to accommodate a bag or other food receptacle 40.

As shown in the drawings, the front wall 27 of the dispensing portion 25 is shown to include an aperture 42 which is enclosed by a boot 45. As shown in FIGS. 2 and 3 of the drawings, the boot 45 is formed of a flexible resilient material, such as rubber, and is accordion shaped in configuration, thereby to be capable of reciprocating movement. Surrounding the aperture 42 along the front wall 27 of the dispensing portion 25 is a T-shaped flange 43 which is formed integrally with the front wall 27. The inner end 46 of the boot 45 is provided with a T-shaped channel 47 which is designed to matingly engage the T-shaped flange 43. As shown in the drawings, the boot 45 is friction fitted to the front wall 27 of the dispensing portion 25 by matingly engaging the T-shaped channel 47 of the inner end 46 of the boot 45 to the T-shaped flange 43. If desired, and where deemed necessary, an adhesive material may be applied to ensure that the channel 47 and flange 43 remain fixedly secured together thereby to prevent unauthorized removal of the boot 45 and provide access to an unauthorized person.

The outer end 48 of the boot 45 is provided with aperture fitting 50 and is designed to accommodate a scoop 52 therethrough. More specifically, the scoop 52 is shown to be provided with the handle portion 53 which fits through the aperture fitting 50. The interior end of the scoop 52 is provided with a product cup 55 which, as shown in FIGS. 2 and 5 of the drawings, is designed to permit the operator to capture food produce from the incline ramp 32, and to deposit the same down the food transport ramp 33 into the exit chute portion 45 and into the receptacle 40.

As particularly illustrated in FIGS. 2 and 3 of the drawings, it is anticipated that the handle portion 53 of the scoop 52 is friction fitted within the apertured fitting 50, and may be designed to either be slideably fitted therein, or alternatively, an adhesive product may be applied to ensure that the handle 53 remains in position within the apertured fitting 50. Where the handle 53 is securely fixed in position within the apertured fitting 50, the operator of the device may manipulate the scoop 52 by seizing the grasp portion 56 of the handle 53 and manipulating the scoop in order to seize produce from the ramp 32 by means of the product cup 55 to deposit the same in the exit chute portion 35 as previously indicated.

The advantage of the two component food retrieval system illustrated herein, consisting of the boot 45 and the scoop 52 is that the food retrieval system has been greatly simplified while nevertheless permitting the maximum degree of movement of the scoop 52 within the interior confines of the dispensing portion 25. As is illustrated in FIG. 3 of the drawings, by providing the system with a flexible boot 45, the scoop 52 may be manipulated in reciprocating movement, that is forwardly and rearwardly, as well as the lateral movement, that is side-to-side, and in an arcuate or orbital movement (see FIG. 2) such that the producct cup 55 of the scoop 52 may be raised upwardly to capture food product and then move downwardly to pull the food product off of the ramp 32, and onto the food transport ramp 33 and deposit the same in the exit chute portion 35. Hence, the food retrieval system of the present invention greatly simplifies the number of elements and components used to create a food retrieval system for a sealed container, while maximizing the degree of movement of the scoop within the dispensing portion thereby simplifying and rendering the food retrieval process greatly more efficient.

Another feature of the present invention is to provide the exit chute portion with positive closure means 60 for closing off the lower portion of the exit chute portion 35 during the food retrieval process. As shown in FIG. 7 of the drawings, the closure means 60 is shown to consist of a pair of closure doors 62 and 63 respectively, which are designed to matingly engage along the inner ends thereof. Each of the closure doors 62 and 63 is provided with a gear plate 64, each having a plurality of gear teeth 65 formed therein. The gear teeth meshingly engage one another, which in turn control the opening and closing of the closure doors 62 and 63 respectively. As shown in FIG. 7 of the drawings, gear plate 64(a) is actually the driving gear plate, while the gear plate (64(b) is the driven gear plate. The gear plates 64 and 64(b) are formed integrally with the closure doors 63 and 62 respectively, and are manipulated by a controller 68. The controller 68 includes a handle portion 69 and a controller portion 71. The controller portion 71 is shown to fit within a matingly designed aperture 66 and closure door 63 thereby to drivingly open the closure door 63. Given the configuration and location of the respective gear plates 64(a) and 64(b), and the meshingly engaging teeth 65, as the handle 69 of the controller 68 drives the gear plate 64(a) into a downward direction, the teeth cause the driven gear plate 64(b) to similarly open the closure door 62 in response to the manipulation of the handle 69.

The assembly of the controller 68 is completed by means of a loop spring 73 which includes an outer end 74 which is secured to the inner wall 29 of the dispensing portion 25, as shown in FIG. 4 of the drawings, and an inner end 75 which is secured within a slot 72 provided in the controller portion 71 of the controller 68. The assembly is completed by means of a bushing 77 which functions to space the loop spring 73 from the outer wall of the exit chute portion 35 and to provide a bearing surface therefor.

As shown in FIGS. 5 and 6 of the drawings, the mode of operation of the closure means 60 is illustrated. As shown in FIG. 5 of the drawings, the controller 68 is shown in the closed position with the closure ddoors 62 and 63 matingly engaged in the closed position. The operator may manipulate the scoop 52 to withdraw product from the product ramp 32 and to pull the product until it exits via the food transport ramp 33 into the dispensing portion 35 of the container 10. Since the closure doors 62 and 63 are in the closed position, the food will be arrested on the top portion thereof. When the operator has withdrawn the desired quantity of food product from the ramp 32, they may then grasp the handle 69 of the controller 68 by depressing the handle 69 downwardly, as shown in FIG. 6 of the drawings. This motion will drive gear plate 64(a), which in turn drives the driven gear plate 64(b) opening both closure doors 62 and 63 thereby releasing the food product into the receptacle 40. When the operator releases the handle 69, the action of the loop spring 73 will cause the handle 69 to move upwardly, and return to its closed position by causing the gear plate 64(a) to drive gear plate 64(b), and therefore the corresponding closure doors 62 and 63 into the closed position as shown in FIG. 5 of the drawings. Hence, the operator is no required to manipulate the handle 69 in any manner in order to ensure that the closure doors 62 and 63 respectively will rest back into their closed position in order to prevent unauthorized access into the interior confines of the container 10.

It will be appreciated, however, that the precise instruction of the closure means 60 may be varied in many respects. Hence, the precise details of a closure system is not deemed to be particularly pertinent with respect to the present invention, other than it is deemed desirable to have a closure system for the exit chute portion of the container 10 in order to prevent any unauthorized tampering with the food product contained within the container 10. It is deemed desirable, however, to have a closure system provided for the container which has a positive ability to return to the closed position when the operator completes the food retrieval process in order to eliminate the possiblity of the operator forgetting to closes the system once the food retrieval process has been completed. The closure means provided in accordance with the present invention and as specifically illustrated in the drawings is intended to be as simple as possible thereby to eliminate expensive manufacturing costs incident to the manufacturing of the container as an overall unit system.

The other feature of the present invention was to provide a food retrieval system associated with the container which minimizes the number of moving parts and greatly simplifies the construction and manufacturing costs associated therewith, while nevertheless, providing a system which ensures sterility, and positively prevents product tampering with product contained within the confines of the container. The present boot 45 and scoop 52 system has not reduced the food retrieval system to a two piece component while at the same time, permitting wide range of movement of the scoop within the interior confines of the container 10 in order to render the food retrieval process ultimately efficient. Hence, the combination of a simplified but more efficient food retrieval system in conjunction with a positive closure means for ensuring the integrity of the interior confines of the sealed barrier container renders the present sealed barrier container system an improvement over the systems heretofore disclosed in the art, or patented by applicant's prior patents as indicated hereinabove.

While there has been disclosed what is at present considered to be the preferred embodiments of the invention, it will be understood that various modifications may be made therein and it is intended to cover in the appended claims all such modification as fall within the true spirit and scope of the invention.

What is claimed is:

1. A sealed barrier container of the type providing limited access to the interior confines of the container and adapted to contain a supply of bulk food product for metered dispensing therefrom, the container having an upper portion, a base for supporting said continer and a dispensing portion positioned intermediate therebetween, the upper portion having a bulk product hopper for containing a supply of bulk product, the dispensing portion being in operative relation with respect to said hopper and including at least one product ramp in communication with the hopper and extending outwardly therefrom to an exit chute portion, the improvement comprising in combination, the dispensing portion of said container having an enlarged opening positioned in the front portion thereof, a T-shaped flange surrounding said enlarged opening in the front portion of said dispensing portion and formed integrally therewith, a flexible boot formed from a flexible resilient material and having an outer end and an inner end, said inner end of said flexible boot provided with a T-shaped channel formed integrally therewith and adapted for mounting engagement with said T-shaped flange surrounding the enlarged opening in the front portion of said dispensing portion, said boot adapted for mounting engagement on said container thereby to enclose said enlarged opening in the front portion of said dispensing portion, said flexible boot having an accordion style configuration to enhance the flexibility thereof, said outer end of said boot provided with an apertured fitting, said apertured fitting completely encircling and carrying said scoop means therein such that said scoop means is connected to said sealed barrier container solely and entirely by said apertured fitting of said boot while permitting said scoop means the full range of movement including lateral movement, and full orbital movement within the confines of the sealed barrier container, said scoop means including an elongate handle having an outer and extending through said apertured fitting of said boot and including a grasp portion for permitting the manipulation of said scoop means by a user, and an inner end adapted to retrieve product from the product ramp, said apertured fitting portion of said boot being in sealing engagement with a portion of the outer end of said handle of said scoop means, while permitting reciprocating movement of said handle in said apertured fitting, said container further including movable closure means carried in said exit chute portion alternately movable between a closed position to trap product therein and an open position to release product therefrom, whereby a user of said product containing container may grasp the handle along the outer grasp portion thereof and manipulate the inner end of said scoop means by manipulating said scoop means carried by said flexible boot to retrieve product from the product ramp and deposit the same in the exit chute portion of the container, the scoop means being capable of reciprocating movement, lateral movement as well as orbital movement as a result of the single point of attachment of said scoop means to said boot, thereby to permit product removal from a totally sealed container by manipulation of an externally extending scoop means and avoid any possible product contamination.

2. The improved container is set forth in claim 1 above, wherein said closure means is formed by a pair of closure doors, each of said closure doors having an outer side edge adapted for pivotal mounting within said exit chute and mating inner side edges, said mating inner side edges adapted to alternately open and close, and control means for controlling the alternate opening and closing of said closure doors.

3. The improved container as set forth in claim 2 above, wherein each of said closure doors includes a toothed gear plate, each of said teethed gear plates being in mating engagement thereby to control the alternate opening and closing of said closure doors, and a controller mounted to at least one of said closure doors for controlling the alternate opening and closing of said closure door, the other of said pair of closure doors being driven by the action of said mating toothed gear plate formed thereon.

4. The improved container as set forth in claim 2 above, wherein said controller further includes a spring for biasingly urging said controller into a closure door closed position, said spring carried between the container base and said controller to assure positive closing of the closure doors upon completion of the food retrieval process.

* * * * *